US011434898B2

(12) United States Patent
Chang et al.

(10) Patent No.: US 11,434,898 B2
(45) Date of Patent: Sep. 6, 2022

(54) DEPRESSURIZING DEVICE

(71) Applicant: KOGE MICRO TECH CO., LTD., New Tapei (TW)

(72) Inventors: Chih Chang, New Taipei (TW); Shu-Hong Lin, New Taipei (TW)

(73) Assignee: KOGE MICRO TECH CO., LTD., Taipei (TW)

( * ) Notice: Subject to any disclaimer, the term of this patent is extended or adjusted under 35 U.S.C. 154(b) by 71 days.

(21) Appl. No.: 16/698,268

(22) Filed: Nov. 27, 2019

(65) Prior Publication Data

US 2020/0095988 A1 Mar. 26, 2020

Related U.S. Application Data

(62) Division of application No. 15/279,447, filed on Sep. 29, 2016, now Pat. No. 10,557,466.

(30) Foreign Application Priority Data

Apr. 28, 2016 (TW) ..... 105113290

(51) Int. Cl.
*F04B 49/24* (2006.01)
*F04B 53/10* (2006.01)
(Continued)

(52) U.S. Cl.
CPC ..... *F04B 49/24* (2013.01); *F04B 53/1022* (2013.01); *F04B 53/1025* (2013.01); *F04B 39/08* (2013.01); *F04B 39/1013* (2013.01)

(58) Field of Classification Search
CPC .. F04B 49/24; F04B 53/1022; F04B 53/1025; F04B 7/0275; F04B 7/0266;
(Continued)

(56) References Cited

U.S. PATENT DOCUMENTS 1,380,442 A ‡ 6/1921 Trumble ..... F02M 1/00 123/510
1,792,920 A ‡ 2/1931 Myers ..... F04B 43/04 310/34
(Continued)

FOREIGN PATENT DOCUMENTS

DE 102013021913 A1 ‡ 4/2015 ..... F04B 1/141
DE 102013021913 A1 4/2015
(Continued)

*Primary Examiner* — Craig J Price
(74) *Attorney, Agent, or Firm* — Juan Carlos A. Marquez; Marquez IP Law Office, PLLC

(57) ABSTRACT

A depressurizing device includes a valve base, a first valve, a flexible member, and a top cover. The valve base has a pressure chamber and an outgassing chamber. Top and bottom surfaces of the pressure chamber have an opening and a first valve port respectively. The first valve is located in the pressure chamber and covers the first valve port. The flexible member is disposed on the valve base and has a depressurizing valve and a first outgassing port, the depressurizing valve covers the opening, and the first outgassing port is communicated with the outgassing chamber. A first outgassing channel is at least formed on the flexible member and communicates the pressure chamber to the outside of the valve base. The top cover is disposed on the flexible member and has a first depressurizing port and a second outgassing port.

6 Claims, 13 Drawing Sheets

(51) Int. Cl.
*F04B 39/10* (2006.01)
*F04B 39/08* (2006.01)

(58) Field of Classification Search
CPC ..... F04B 7/0233; F04B 7/02; F04B 49/03; F04B 49/225; F04B 49/04; F04B 49/043; F04B 49/0054; F04B 49/0026; F04B 39/08; F04B 39/108; F04B 1/141; F04B 1/122; F04B 39/1013; F04B 39/1033; F04B 49/035; Y10T 137/87169; Y10T 137/3631; F16K 7/12; F16K 7/17
USPC ..... 137/225, 596; 417/411, 412, 413.1, 143, 417/296, 303, 307
See application file for complete search history.

(56) References Cited

U.S. PATENT DOCUMENTS 1,802,136 A ‡ 4/1931 Carter ..... F02M 59/14 417/413.1
1,834,977 A ‡ 12/1931 Schweisthal ..... F02M 1/00 123/146.5 R
2,797,647 A * 7/1957 Floraday ..... F04B 1/145 417/269
3,273,505 A ‡ 9/1966 Miles ..... F02M 1/00 310/32
3,580,273 A ‡ 5/1971 Schwarz ..... B60T 11/28 137/217
4,143,998 A ‡ 3/1979 O'Connor ..... F04B 53/1025 417/413.1
4,657,490 A * 4/1987 Abbott ..... A61M 5/14224 417/478
4,794,940 A * 1/1989 Albert ..... F16K 31/1266 137/1
6,158,971 A ‡ 12/2000 Takagi ..... F04B 1/124 417/244
6,382,928 B1 * 5/2002 Chang ..... F04B 45/027 417/269
6,752,599 B2 ‡ 6/2004 Park ..... F04B 43/06 417/395
6,843,643 B2 * 1/2005 Fukami ..... F04B 43/026 417/413.1
7,284,966 B2 * 10/2007 Xu ..... F04B 53/106 417/395
7,377,756 B2 ‡ 5/2008 Hori ..... F04B 45/043 417/413.1
7,717,682 B2 ‡ 5/2010 Orr ..... F04B 7/02 417/395
8,272,850 B2 * 9/2012 Stenberg ..... F04B 43/04 417/413.1
8,784,080 B2 * 7/2014 Dorfler ..... F04B 43/0054 417/480
8,801,403 B2 * 8/2014 Cai ..... F04B 53/06 417/413.1
9,033,683 B2 * 5/2015 Kodama ..... A61B 5/0235 417/413.1
9,091,260 B2 ‡ 7/2015 Chang ..... F04B 45/043
9,217,425 B2 ‡ 12/2015 Looi ..... F04B 9/045
9,453,504 B2 * 9/2016 Fukami ..... F04B 45/04
9,739,271 B2 ‡ 8/2017 Chang ..... F04B 1/122
9,943,196 B2 * 4/2018 Mak ..... B05B 7/0416
10,047,870 B2 ‡ 8/2018 Wu ..... F16K 7/12
10,065,199 B2 ‡ 9/2018 Twaroski ..... B05B 15/20
10,080,468 B2 ‡ 9/2018 Ciavarella ..... A47K 5/14
10,143,339 B2 ‡ 12/2018 Ciavarella ..... A47K 5/16
10,641,262 B2 * 5/2020 Inoue ..... F04B 43/0045
2002/0021717 A1 ‡ 2/2002 Hedayat ..... H04L 12/6418 370/508
2009/0169402 A1 ‡ 7/2009 Stenberg ..... F04B 35/045 417/413.1
2013/0034452 A1 ‡ 2/2013 Itahara ..... F04B 43/02 417/321
2013/0136637 A1 ‡ 5/2013 Chang ..... F04B 41/00 417/437
2015/0118084 A1 ‡ 4/2015 Chang ..... F04B 1/122 417/569
2021/0071658 A1 * 3/2021 Wang ..... F04B 49/10

FOREIGN PATENT DOCUMENTS

JP 2006-219996 A ‡ 8/2006
JP 2006-219996 A 8/2006
JP 2016-509151 A ‡ 3/2016
JP 2016-509151 A 3/2016
TW 187460 ‡ 7/1992
TW 479769 U ‡ 3/2002
TW 479769 U 3/2002
TW M397458 U1 ‡ 2/2011
TW M397458 U1 2/2011
TW M476206 U ‡ 4/2014
TW M476206 U 4/2014

* cited by examiner
‡ imported from a related application

DEPRESSURIZING DEVICE

RELATED APPLICATIONS

This application claims priority to Taiwan Application Serial Number 105113290, filed Apr. 28, 2016, which is herein incorporated by reference.

BACKGROUND

Field of Invention

The present invention relates to a depressurizing device.

Description of Related Art

By current conventions, if a pump requires depressurization after a boost in pressure, the corresponding practice is to combine the pump with the solenoid valve, and use a solenoid valve to depressurize. However, this approach requires additional cost for the solenoid valve. Moreover, if the solenoid valve is damaged, the entire depressurizing device will not work and must be replaced, and this will result in a cost burden. Therefore, how to automatically and quickly depressurize a device after inflation can reduce the cost to replace the depressurizing valve member is a problem to be solved by the art.

SUMMARY

In order to solve the problems of the prior art, the present disclosure provides a depressurizing device.

The disclosure herein provides a depressurizing device. The depressurizing device includes a valve base, a first valve, a flexible member, and a top cover. The valve base has a pressure chamber and an outgassing chamber. Top and bottom surfaces of the pressure chamber have an opening and a first valve port respectively, and a bottom surface of the outgassing chamber has a second valve port. The first valve is located in the pressure chamber and covers the first valve port. The flexible member is disposed on the valve base and has a depressurizing valve and a first outgassing port. The depressurizing valve covers the opening. The first outgassing port is communicated with the outgassing chamber. The first outgassing channel is at least formed on the flexible member and communicates the pressure chamber to the outside of the valve base. The top cover is disposed on the flexible member and has a first depressurizing port and a second outgassing port. The first depressurizing port faces the depressurizing valve. The second outgassing port is communicated with the first outgassing port. The depressurizing valve is configured to deform caused by the affect of an atmosphere in the pressure chamber, so as to selectively close the first depressurizing port or leave the first depressurizing port to form a second outgassing channel between the top cover and the flexible member. The second outgassing channel is communicated with the first depressurizing port and the second outgassing port.

The disclosure herein also provides a depressurizing device. The depressurizing device includes a valve base, a first valve, a flexible member, and a top cover. The valve base has a pressure chamber and an outgassing chamber. Top and bottom surfaces of the pressure chamber have an opening and a first valve port respectively. The valve base further has a valve port channel being communicated with the pressure chamber through the first valve port. A bottom surface of the outgassing chamber has a second valve port.

A first outgassing channel is at least formed on the valve base and communicates the valve port channel to the outside of the valve base. The first valve is located in the pressure chamber and at least partially covers the first valve port to form a depressurizing gap. The flexible member is disposed on the valve base and has a depressurizing valve and a first outgassing port. The depressurizing valve covers the opening. The first outgassing port is communicated with the outgassing chamber. The top cover is disposed on the flexible member and has a first depressurizing port and a second outgassing port. The first depressurizing port faces the depressurizing valve. The second outgassing port is communicated with the first outgassing port. The depressurizing valve is configured to deform caused by the affect of an atmosphere in the pressure chamber, so as to selectively close the first depressurizing port or leave the first depressurizing port to form a second outgassing channel between the top cover and the flexible member. The second outgassing channel is communicated with the first depressurizing port and the second outgassing port.

In some embodiments of the present disclosure, the depressurizing device further includes a second valve located in the outgassing chamber and covering the second valve port.

In some embodiments of the present disclosure, a cross-sectional area of the first outgassing channel is in a range from $1\times10^{-3}$ mm$^2$ to 1 mm$^2$.

In some embodiments of the present disclosure, the flexible member has a first trench, the valve base has a second trench, and the first trench and the second trench form the first outgassing channel.

In some embodiments of the present disclosure, the first outgassing channel penetrates the flexible member.

In some embodiments of the present disclosure, the valve base has a third outgassing channel communicating the pressure chamber to the outside of the valve base.

In some embodiments of the present disclosure, the valve base has a third outgassing channel communicating the pressure chamber to the outgassing chamber.

In some embodiments of the present disclosure, the sum of a cross-sectional area of the first outgassing channel and a cross-sectional area of the third outgassing channel is in a range from $1\times10^{-3}$ mm$^2$ to 1 mm$^2$.

In some embodiments of the present disclosure, the depressurizing valve has an annular groove or a cross-shaped groove.

According to the above-described structural arrangement, the depressurizing device of the present disclosure includes the depressurizing valve. The first outgassing channel is at least formed on the depressurizing valve. Furthermore, the first outgassing channel may be also at least formed on the valve base to communicate the valve port channel to outside of the valve base. In doing so, the first outgassing channel can communicate the pressure chamber to the outside of the valve base, thereby accelerating recess speed of the depressurizing valve during the depressurizing period, and thus the depressurizing valve quickly and automatically leaves the first depressurizing port, and thus leading to form the second outgassing channel between the top cover and the flexible member to communicate the first depressurizing port to the second outgassing port, and causing the depressurizing device having a faster depressurizing efficiency. Furthermore, the outgassing channel is formed on the flexible member, thereby enabling the outgassing channel can be formed by the method, such as, an injection molding or a thermoforming technology, and thus may reducing the production costs. In addition, because the flexible member is easier configured to be molded, users can manufacture a variety of types of the outgassing channels or recesses. Moreover, users can replace the corresponding type of the flexible member having the outgassing channels or the recesses thereon according to their requirements, and can replace the flexible member quickly and at low-cost.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

The following disclosures feature of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Figure 1A:
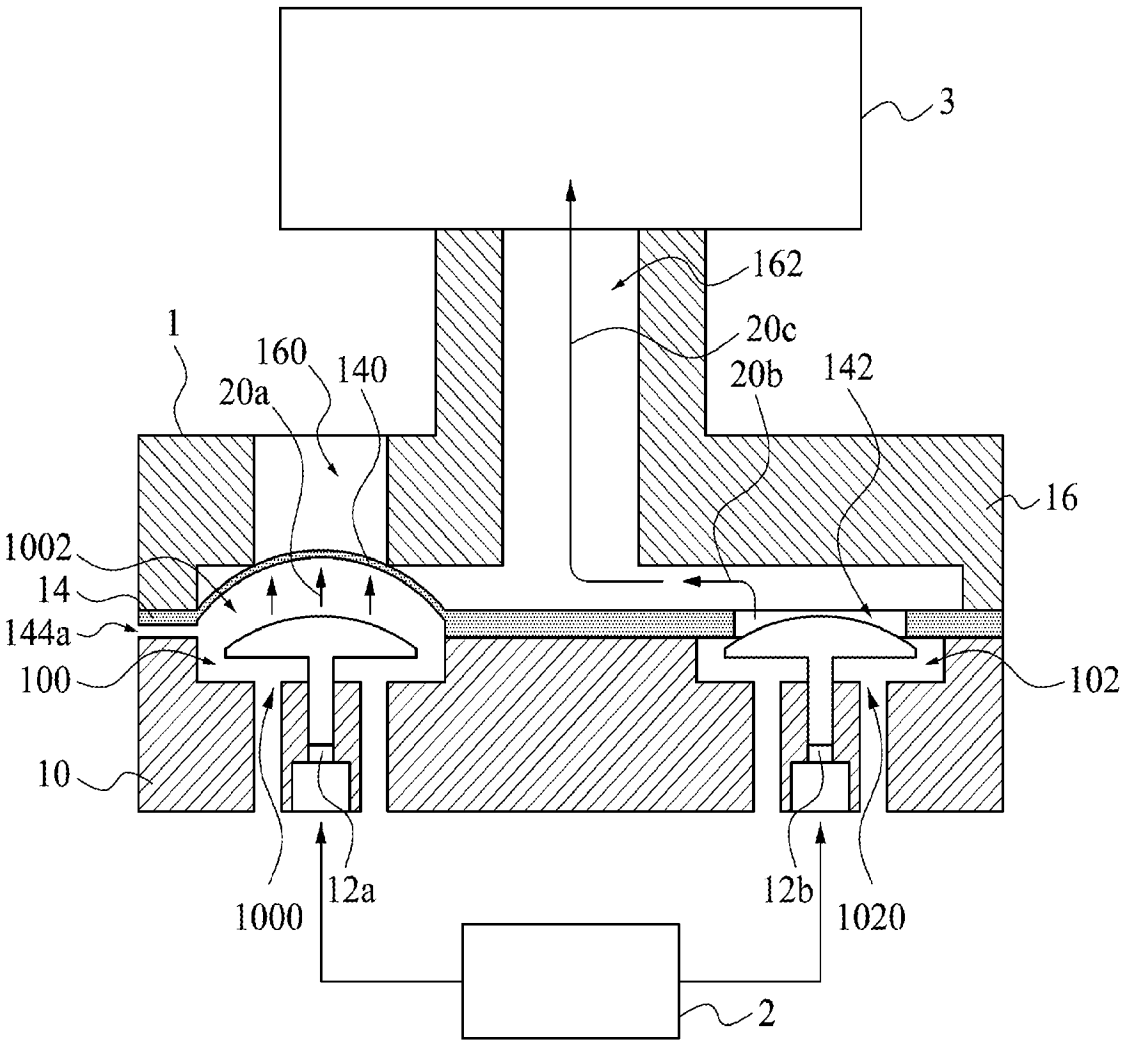
FIG. 1A is a schematic cross section view of a depressurizing device in an outgassing status in accordance with some embodiments of the present disclosure.
Figure 1B:
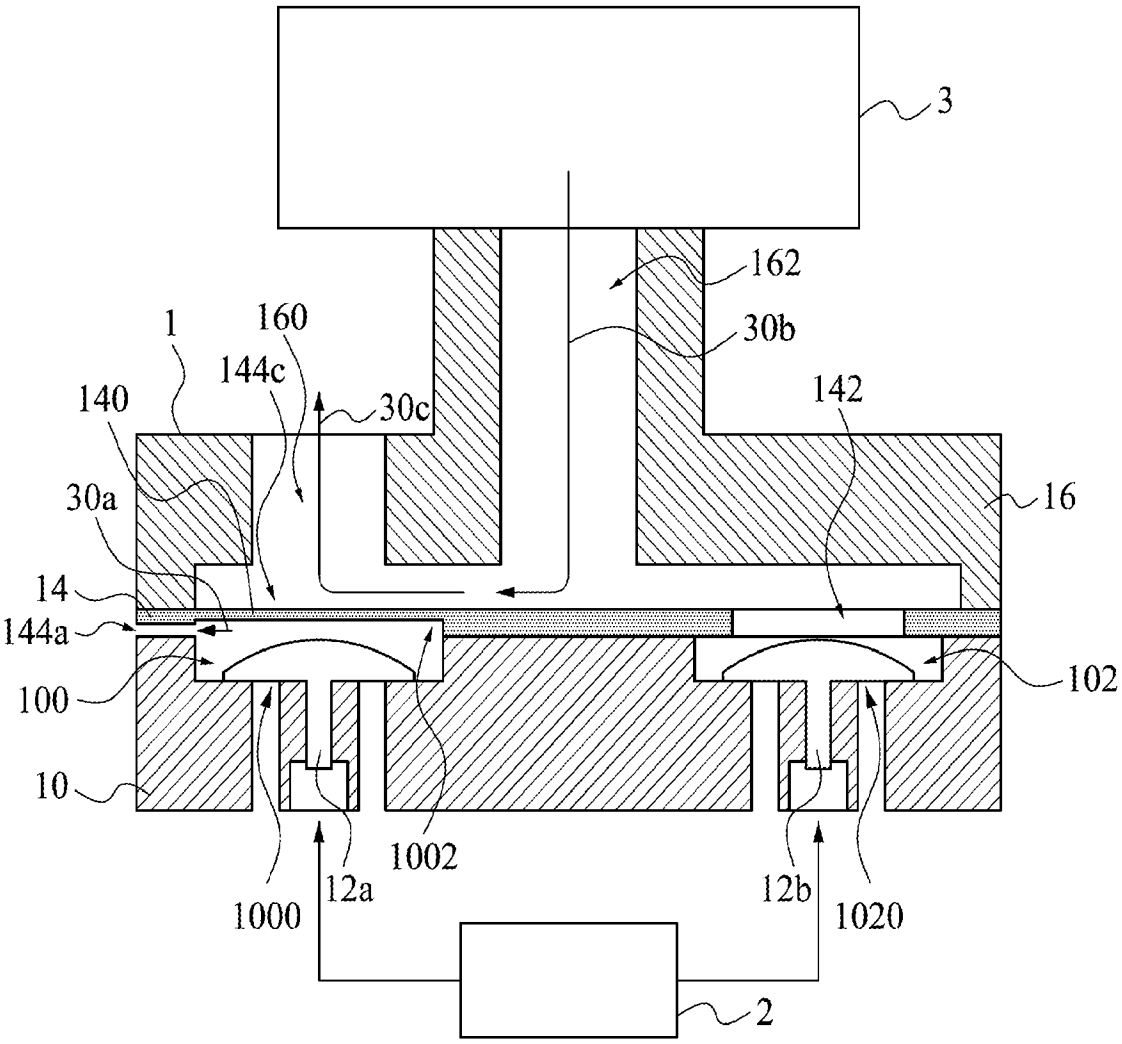
FIG. 1B is a schematic cross section view of the depressurizing device in a deflated status in an outgassing status in accordance with some embodiments of the present disclosure.

Reference is made to FIG. 1A and FIG. 1B. FIG. 1A is a schematic cross section view of a depressurizing device 1 in an outgassing status in accordance with some embodiments of the present disclosure. FIG. 1B is the schematic cross section view of the depressurizing device 1 in a deflated status in an outgassing status in accordance with some embodiments of the present disclosure. Firstly, as shown in the figures, in the present disclosure, the depressurizing device 1 includes a valve base 10, a first valve 12*a*, a second valve 12*b*, a flexible member 14, and a top cover 16. The structure and function of the elements and the relationship therebetween are described in detail hereinafter.

The valve base 10 has a pressure chamber 100 and an outgassing chamber 102. Top and bottom surfaces of the pressure chamber 100 have an opening 1002 and a first valve port 1000 respectively, and a bottom surface of the outgassing chamber 102 has a second valve port 1020. The first valve 12*a* is located in the pressure chamber 100 and covers the first valve port 1000. The second valve 12*b* is located in the outgassing chamber 102 and covers the second valve port 1020. The flexible member 14 is disposed on the valve base 10 and has a depressurizing valve 140 and a first outgassing port 142. The depressurizing valve 140 covers the opening 1002. The first outgassing port 142 is communicated with the outgassing chamber 102. A first outgassing channel 144*a* is at least formed on the flexible member 14 and communicates the pressure chamber 100 to outside of the valve base 10. The top cover 16 is disposed on the flexible member 14 and has a first depressurizing port 160 and a second outgassing port 162. The first depressurizing port 160 faces the depressurizing valve 140. The second outgassing port 162 is communicated with the first outgassing port 142.

Specifically speaking, as shown in FIG. 1A, when the user drives the depressurizing device 1 by a source generating unit 2, gas generated by the source generating unit 2 will enter the depressurizing device 1 through the first valve port 1000 and the second valve port 1020. The gas entering the depressurizing device 1 through the first valve port 1000 forms a pressure, and push the depressurizing valve 140 along a direction 20*a*, and thus the depressurizing valve 140 deforms to close the first depressurizing port 160, and thus leading to the first depressurizing port 160 disposed between the valve base 10 and the top cover 16 cannot communicate with the outgassing chamber 102 and the second outgassing port 162. Therefore, the gas entering the outgassing chamber 102 of the depressurizing device 1 through the second valve port 1020 can pass through the first outgassing port 142 of the flexible member 14 along a direction 20*b*, and enter the second outgassing port 162 along a direction 20*c* rather than enter the first depressurizing port 160. Whereby, the gas can enter an inflatable body 3 through the second outgassing port 162 to achieve an inflatable effect.

Then, as shown in FIG. 1B, when the user stops driving the depressurizing device 1 by a source generating unit 2, the first valve 12*a* and the second valve 12*b* will return to its original position and cover the first valve port 1000 and the second valve port 1020, and thus the gas will not flow back to the source generating unit 2. At the same time, the gas in the pressure chamber 100 passes through a first outgassing channel 144*a* along a direction 30*a* to leakage to outside of the valve base 10. The pressure chamber 100 leakages gas, and thus the depressurizing valve 140 deforms to an undeformed position, and thus leading to the depressurizing valve 140 leaves and open the first depressurizing port 160, thereby forming a second outgassing channel 144*c* located between the top cover 16 and the flexible member 14. The second outgassing channel 144*c* communicates the first depressurizing port 160 and the second outgassing port 162. Therefore, the gas flowing back from the inflatable body 3 passes through the second outgassing port 162 along a direction 30*b* and enters the depressurizing device 1, and the gas passes through the second outgassing channel 144*c* and leakages from the first depressurizing port 160 along a direction 30*c*. In doing so, the first outgassing channel 144*a* can communicate the pressure chamber 100 to the outside of the valve base 10, thereby accelerating recess speed of the depressurizing valve 140 during the depressurizing period, and thus the depressurizing valve 140 quickly and automatically leaves the first depressurizing port 160, and thus leading to form the second outgassing channel 144*c* between the top cover 16 and the flexible member 14 to communicate the first depressurizing port 160 to the second outgassing port 162, and causing the depressurizing device 1 having a faster depressurizing efficiency and not needing to set the solenoid valve.

In some embodiments, the top cover 16 is a non-elastic body. In some embodiments, the first valve 12*a*, the second valve 12*b*, and the flexible member 14 are made of rubber material. In some embodiments, the first valve 12*a* and the second valve 12*b* are umbrella valve, but the present disclosure is not limited thereto. In some embodiments, the portion where the outgassing chamber 102 located at is a polished surface. In some embodiments, value of increasing pressure of the depressurizing device 1 is in a range from 100 mmHg to 400 mmHg.

In some embodiments, a cross-sectional area of the first outgassing channel 144*a* is in a range from $1\times10^{-3}$ $mm^2$ to 1 $mm^2$. In some embodiments, a depressurizing time for the depressurizing device 1 is within 2 seconds.

Figure 2A:
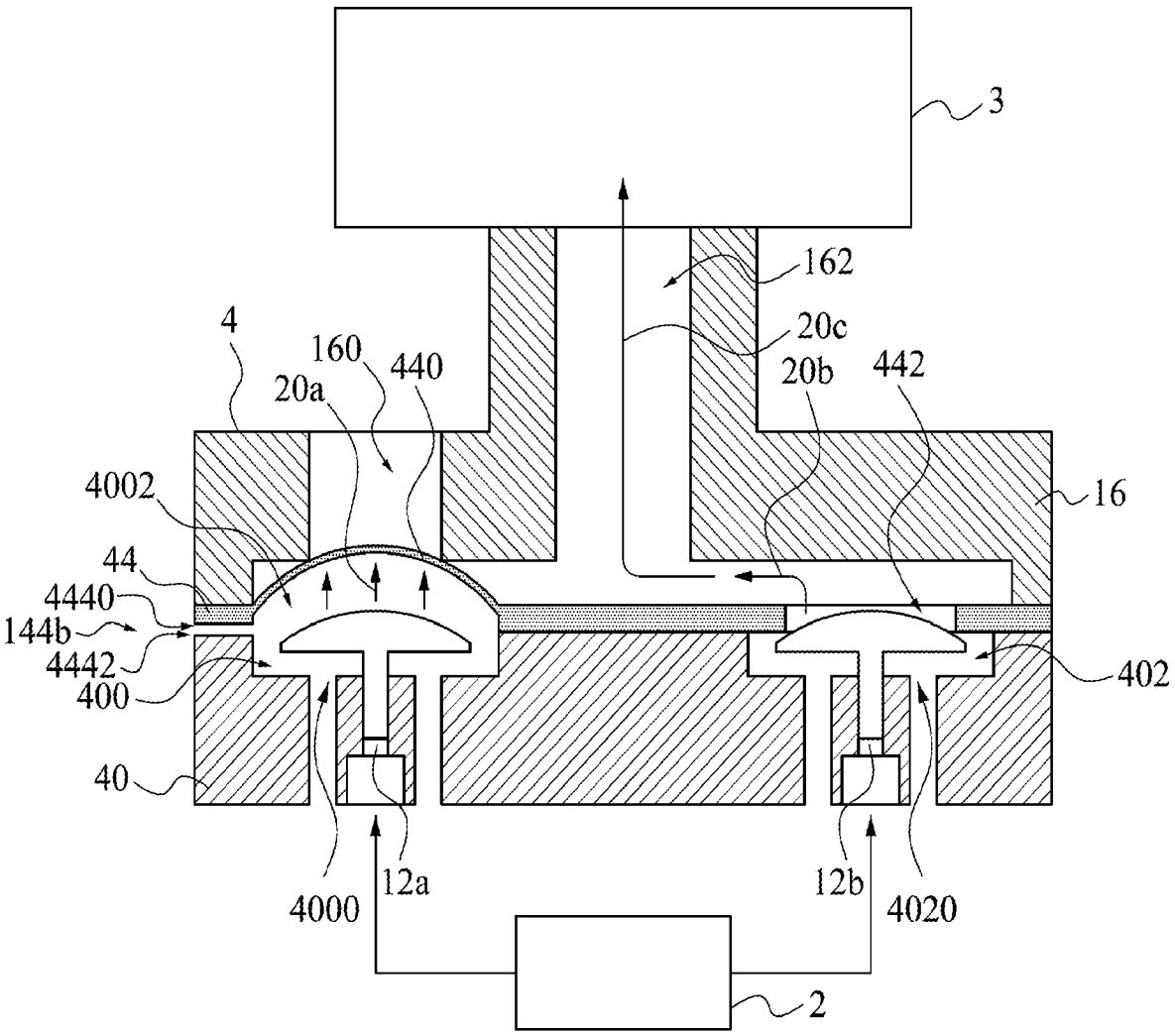
FIG. 2A is a schematic cross section view of a depressurizing device in an outgassing status in accordance with some embodiments of the present disclosure.
Figure 2B:
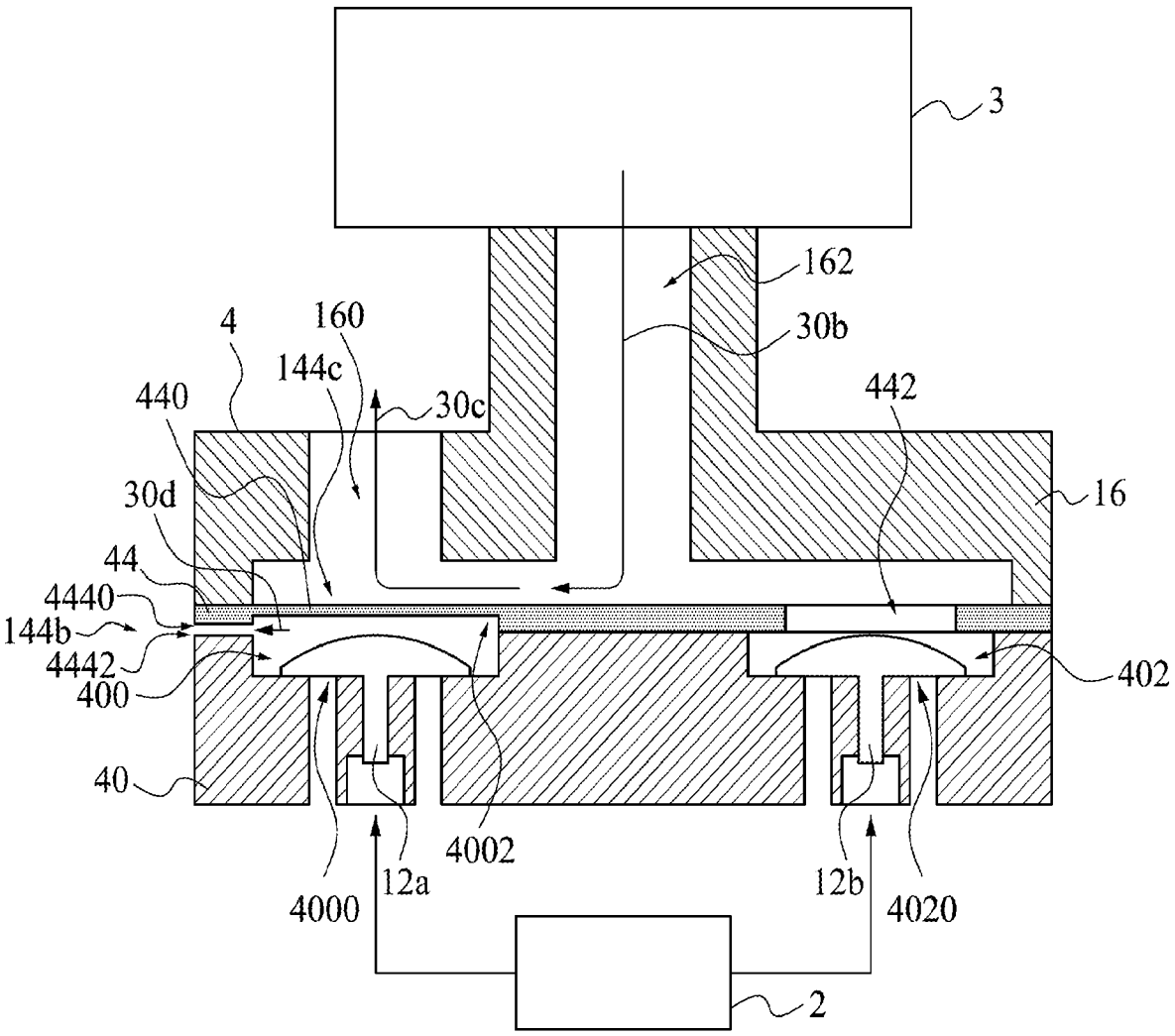
FIG. 2B is the schematic cross section view of the depressurizing device in a deflated status in an outgassing status in accordance with some embodiments of the present disclosure.

Reference is made to FIG. 2A and FIG. 2B. FIG. 2A is a schematic cross section view of a depressurizing device 4 in an outgassing status in accordance with some embodiments of the present disclosure. FIG. 2B is the schematic cross section view of the depressurizing device 4 in a deflated status in an outgassing status in accordance with some embodiments of the present disclosure. Firstly, as shown in the figures, in the present disclosure, the depressurizing device 4 also includes a valve base 40, a first valve 12*a*, a second valve 12*b*, a flexible member 44, and a top cover 16. The structure and function of the elements and the relationship therebetween are substantially the same as those of the embodiments in FIG. 1A and FIG. 1B, and the related detailed descriptions may refer to the foregoing paragraphs, and are not discussed again herein. The difference between the present embodiment and that in FIG. 1A and FIG. 1B are in that the flexible member 44 has a first trench 4440, the valve base 40 has a second trench 4442, and the first trench 4440 and second trench 4442 form a first outgassing channel 144*b* in this embodiment. Therefore, the valve base 10 and the flexible member 14 shown in FIG. 1A and FIG. 1B are respectively replaced with the valve base 40 and the flexible member 44 in this embodiment.

Specifically speaking, as shown in FIG. 2A, when the user drives the depressurizing device 4 by a source generating unit 2, gas generated by the source generating unit 2 will enter the depressurizing device 4 through the first valve port 4000 and the second valve port 4020. The gas entering the depressurizing device 4 through the first valve port 4000 forms a pressure, and push the depressurizing valve 440 along a direction 20*a*, and thus the depressurizing valve 440 deforms to close the first depressurizing port 160, and thus leading to the first depressurizing port 160 disposed between the valve base 40 and the top cover 16 cannot communicate with the outgassing chamber 402 and the second outgassing port 162. Therefore, the gas entering the outgassing chamber 402 of the depressurizing device 4 through the second valve port 4020 can pass through the first outgassing port 442 of the flexible member 44 along a direction 20*b*, and enter the second outgassing port 162 along a direction 20*c* rather than enter the first depressurizing port 160. Whereby, the gas can enter an inflatable body 3 through the second outgassing port 162 to achieve an inflatable effect.

Then, as shown in FIG. 2B, when the user stops drive the depressurizing device 4 by a source generating unit 2, the first valve 12*a* and the second valve 12*b* will return to its original position and cover the first valve port 4000 and the second valve port 4020, and thus the gas will not flow back to the source generating unit 2. At the same time, the gas in the pressure chamber 400 passes through a first outgassing channel 144*b* along a direction 30*d* to leakage to outside of the valve base 40. The pressure chamber 400 leakages gas, and thus the depressurizing valve 440 deforms to depression, and thus leading to the depressurizing valve 440 leaves and open the first depressurizing port 160, thereby forming a second outgassing channel 144*c* located between the top cover 16 and the flexible member 44. The second outgassing channel 144*c* communicates the first depressurizing port 160 and the second outgassing port 162. Therefore, the gas flowing back from the inflatable body 3 passes through the second outgassing port 162 along a direction 30*b* and enters the depressurizing device 4, and the gas passes through the second outgassing channel 144*c* and leakages from the first depressurizing port 160 along a direction 30*c*.

Figure 3A:
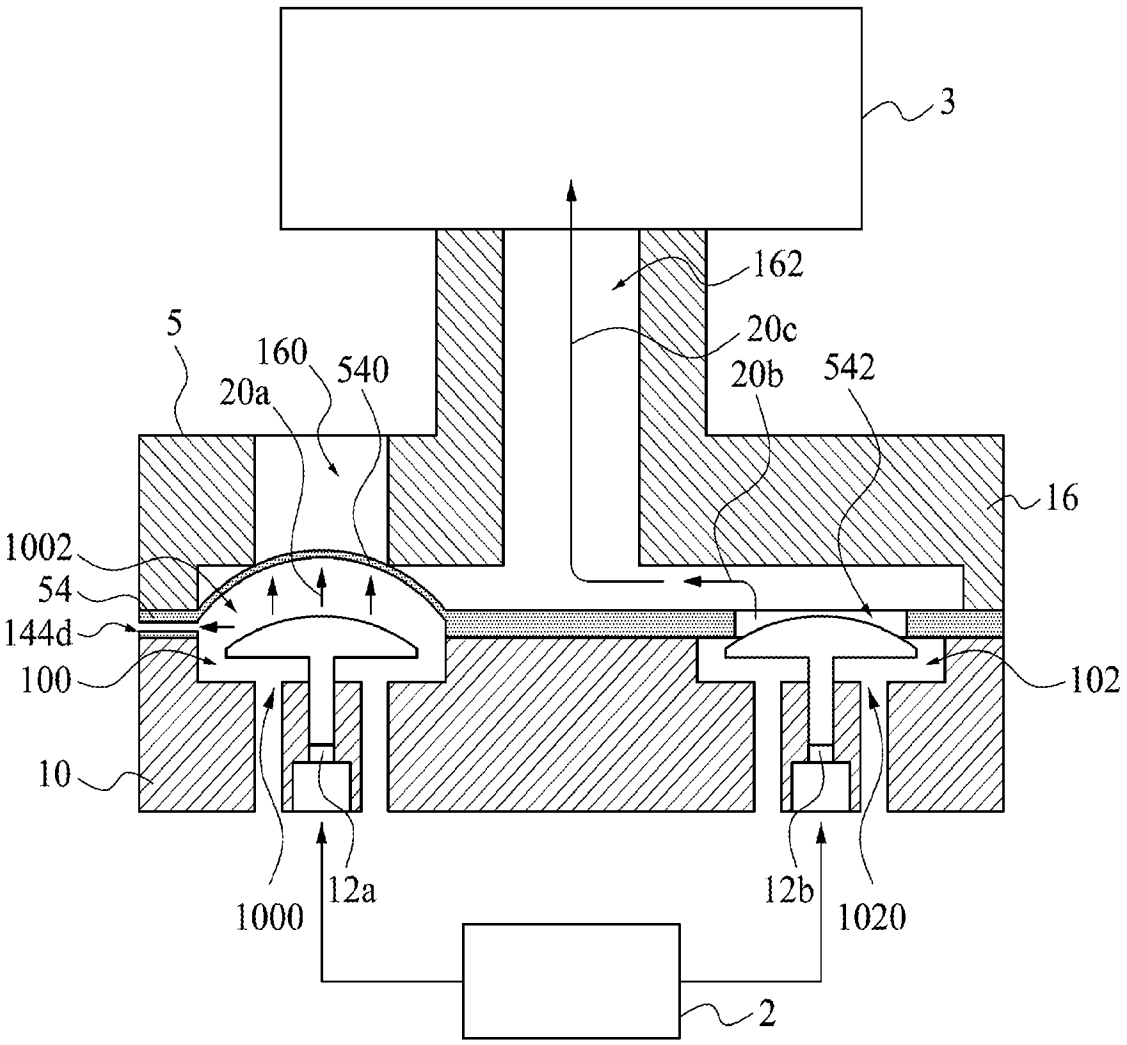
FIG. 3A is a schematic cross section view of a depressurizing device in an outgassing status in accordance with some embodiments of the present disclosure.
Figure 3B:
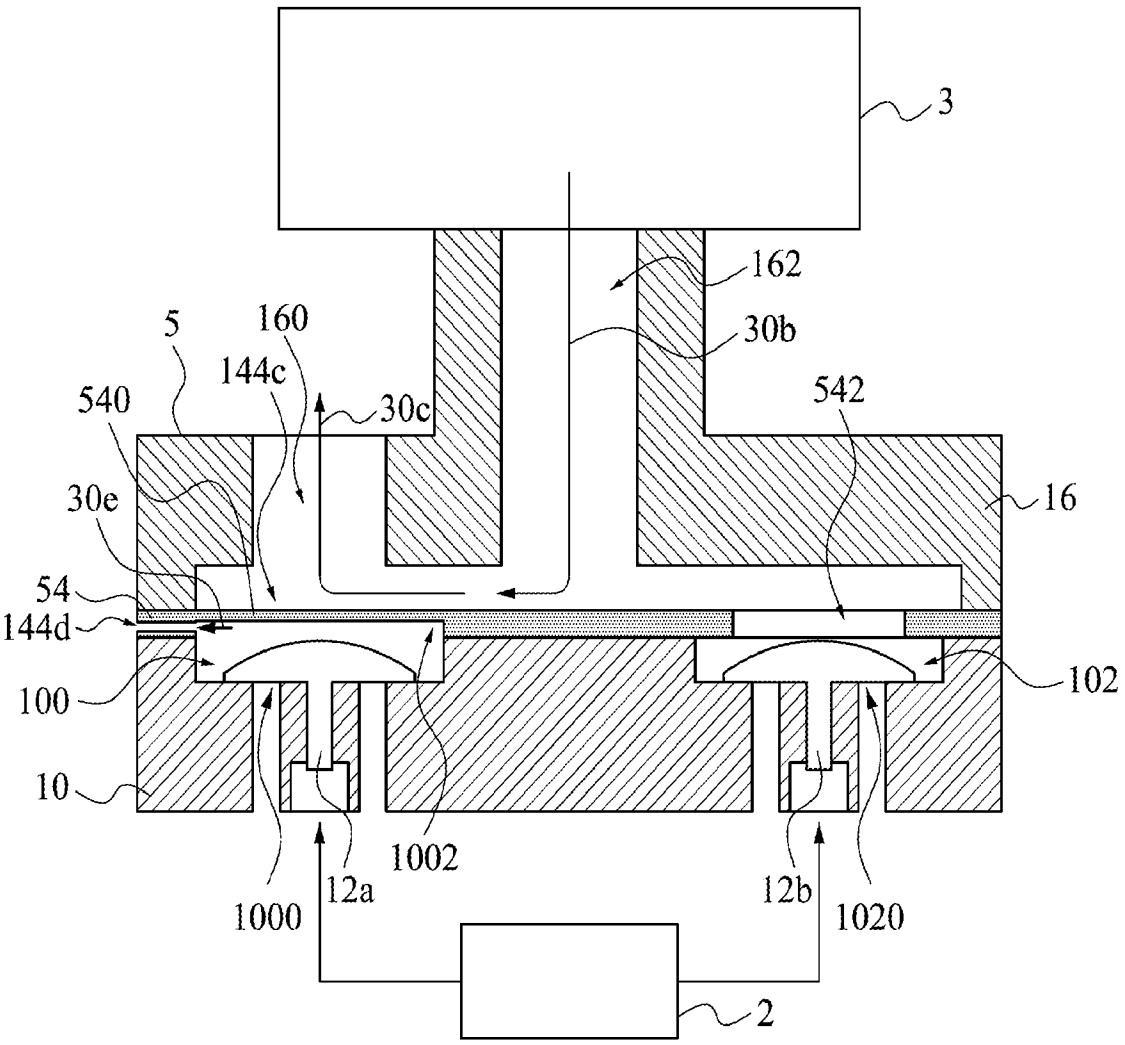
FIG. 3B is a schematic cross section view of the depressurizing device in a deflated status in an outgassing status in accordance with some embodiments of the present disclosure.

Reference is made to FIG. 3A and FIG. 3B. FIG. 3A is a schematic cross section view of a depressurizing device 5 in an outgassing status in accordance with some embodiments of the present disclosure. FIG. 3B is the schematic cross section view of the depressurizing device 5 in a deflated status in an outgassing status in accordance with some embodiments of the present disclosure. Firstly, as shown in the figures, in the present disclosure, the depressurizing device 5 also includes a valve base 10, a first valve 12*a*, a second valve 12*b*, a flexible member 54, and a top cover 16. The structure and function of the elements and the relationship therebetween are substantially the same as those of the embodiments in FIG. 1A and FIG. 1B, and the related detailed descriptions may refer to the foregoing paragraphs, and are not discussed again herein. The difference between the present embodiment and that in FIG. 1A and FIG. 1B are in that a first outgassing channel 144*d* penetrates the flexible member 54 in this embodiment. Therefore, the flexible member 14 shown in the FIG. 1A and FIG. 1B is replaced with the flexible member 54 in this embodiment.

Specifically speaking, as shown in FIG. 3A, when the user drives the depressurizing device 5 by a source generating unit 2, gas generated by the source generating unit 2 will enter the depressurizing device 5 through the first valve port 1000 and the second valve port 1020. The gas entering the depressurizing device 5 through the first valve port 1000 forms a pressure, and push the depressurizing valve 540 along a direction 20*a*, and thus the depressurizing valve 540 deforms to close the first depressurizing port 160, and thus leading to the first depressurizing port 160 disposed between the valve base 10 and the top cover 16 cannot communicate with the outgassing chamber 102 and the second outgassing port 162. Therefore, the gas entering the outgassing chamber 102 of the depressurizing device 5 through the second valve port 1020 can pass through the first outgassing port 542 of the flexible member 54 along a direction 20*b*, and enter the second outgassing port 162 along a direction 20*c* rather than enter the first depressurizing port 160. Whereby, the gas can enter an inflatable body 3 through the second outgassing port 162 to achieve an inflatable effect.

Then, as shown in FIG. 3B, when the user stops drive the depressurizing device 5 by a source generating unit 2, the first valve 12*a* and the second valve 12*b* will return to its original position and cover the first valve port 1000 and the second valve port 1020, and thus the gas will not flow back to the source generating unit 2. At the same time, the gas in the pressure chamber 100 passes through a first outgassing channel 144*d* along a direction 30*e* to leakage to outside of the valve base 10. The pressure chamber 100 leakages gas, and thus the depressurizing valve 540 deforms to depression, and thus leading to the depressurizing valve 540 leaves and open the first depressurizing port 160, thereby forming a second outgassing channel 144*c* located between the top cover 16 and the flexible member 54. The second outgassing channel 144*c* communicates the first depressurizing port 160 and the second outgassing port 162. Therefore, the gas flowing back from the inflatable body 3 passes through the second outgassing port 162 along a direction 30*b* and enters the depressurizing device 5, and the gas passes through the second outgassing channel 144*c* and leakages from the first depressurizing port 160 along a direction 30*c*.

Figure 4A:
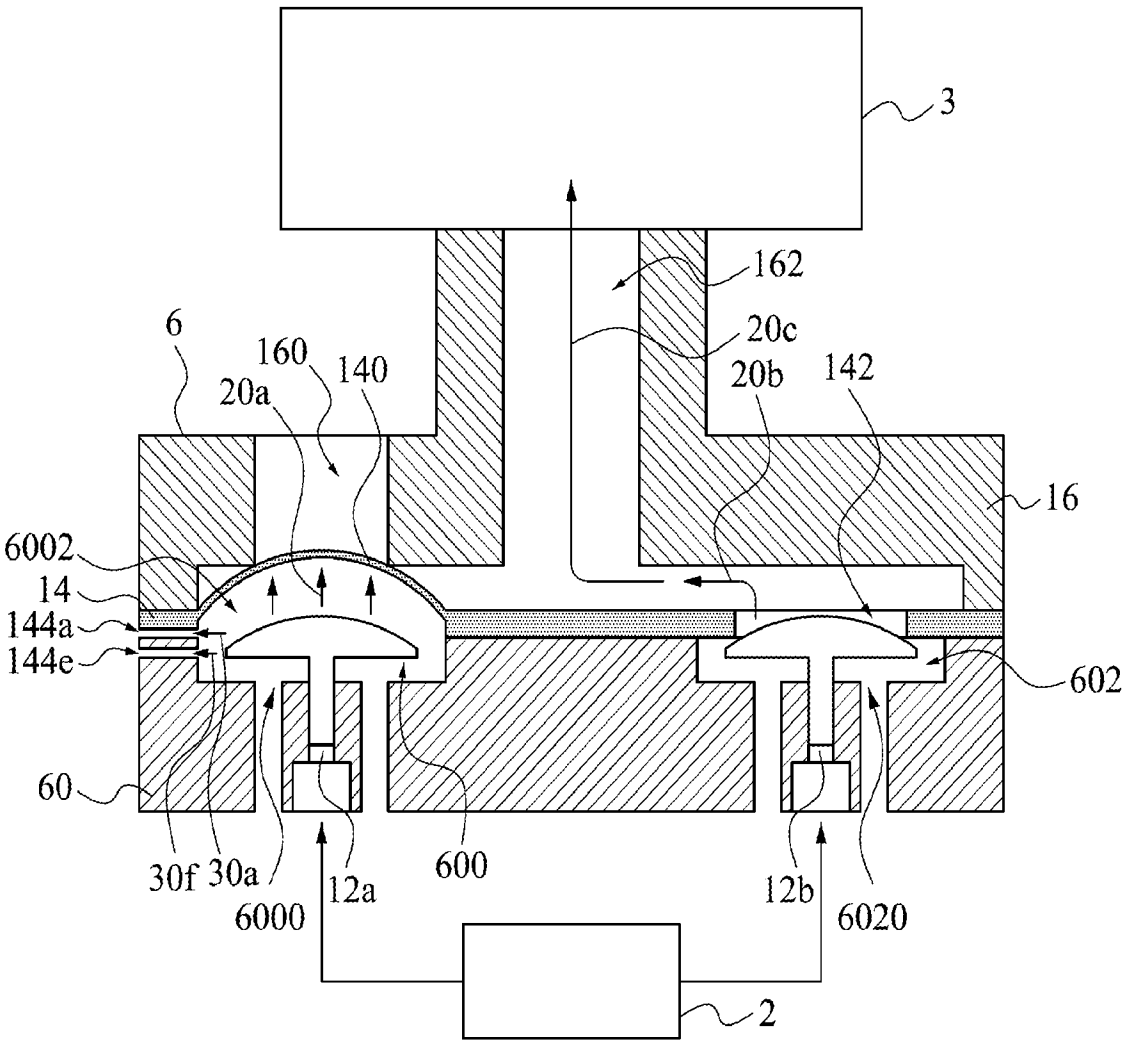
FIG. 4A is a schematic cross section view of a depressurizing device in an outgassing status in accordance with some embodiments of the present disclosure.
Figure 4B:
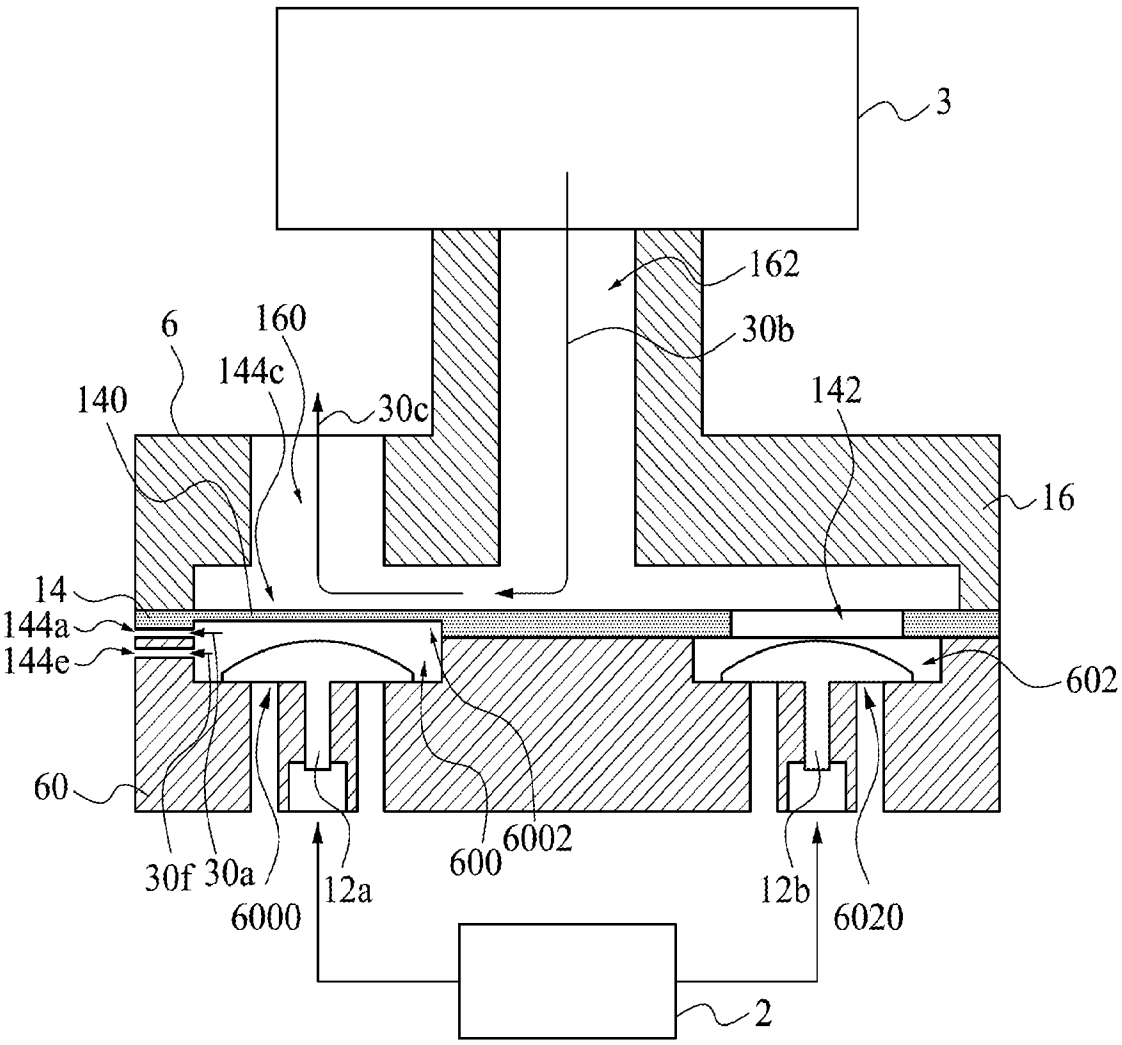
FIG. 4B is a schematic cross section view of the depressurizing device in a deflated status in an outgassing status in accordance with some embodiments of the present disclosure.

Reference is made to FIG. 4A and FIG. 4B. FIG. 4A is a schematic cross section view of a depressurizing device 6 in an outgassing status in accordance with some embodiments of the present disclosure. FIG. 4B is the schematic cross section view of the depressurizing device 6 in a deflated status in an outgassing status in accordance with some embodiments of the present disclosure. Firstly, as shown in the figures, in the present disclosure, the depressurizing device 6 also includes a valve base 60, a first valve 12*a*, a second valve 12*b*, a flexible member 14, and a top cover 16. The structure and function of the elements and the relationship therebetween are substantially the same as those of the embodiments in FIG. 1A and FIG. 1B, and the related detailed descriptions may refer to the foregoing paragraphs, and are not discussed again herein. The difference between the present embodiment and that in FIG. 1A and FIG. 1B are in that the valve base 60 in this embodiment has a third outgassing channel 144*e*. The third outgassing channel 144*e* communicates the pressure chamber 600 to outside of the valve base 60. Therefore, the valve base 10 shown in the FIG. 1A and FIG. 1B is replaced with the valve base 60 in this embodiment.

Specifically speaking, as shown in FIG. 4A, when the user drives the depressurizing device 6 by a source generating unit 2, gas generated by the source generating unit 2 will enter the depressurizing device 6 through the first valve port 6000 and the second valve port 6020. The gas entering the depressurizing device 6 through the first valve port 6000 forms a pressure, and push the depressurizing valve 140 along a direction 20*a*, and thus the depressurizing valve 140 deforms to close the first depressurizing port 160, and thus leading to the first depressurizing port 160 disposed between the valve base 60 and the top cover 16 cannot communicate with the outgassing chamber 602 and the second outgassing port 162. Therefore, the gas entering the outgassing chamber 602 of the depressurizing device 6 through the second valve port 6020 can pass through the first outgassing port 142 of the flexible member 14 along a direction 20*b*, and enter the second outgassing port 162 along a direction 20*c* rather than enter the first depressurizing port 160. Whereby, the gas can enter an inflatable body 3 through the second outgassing port 162 to achieve an inflatable effect.

Then, as shown in FIG. 4B, when the user stops drive the depressurizing device 6 by a source generating unit 2, the first valve 12*a* and the second valve 12*b* will return to its original position and cover the first valve port 6000 and the second valve port 6020, and thus the gas will not flow back to the source generating unit 2. At the same time, the gas in the pressure chamber 600 respectively pass through a first outgassing channel 144*a* and the third outgassing channel 144*e* along direction 30*a* and direction 30*f* to leakage the gas. The pressure chamber 600 leakages gas, and thus the depressurizing valve 140 deforms to depression, and thus leading to the depressurizing valve 140 leaves and open the first depressurizing port 160, thereby forming a second outgassing channel 144*c* located between the top cover 16 and the flexible member 14. The second outgassing channel 144*c* communicates the first depressurizing port 160 and the second outgassing port 162. Therefore, the gas flowing back from the inflatable body 3 passes through the second outgassing port 162 along a direction 30*b* and enters the depressurizing device 6, and the gas passes through the second outgassing channel 144*c* and leakages from the first depressurizing port 160 along a direction 30*c*. In doing so, the first outgassing channel 144*a* and the third outgassing channel 144*e* can enable that the depressurizing valve 140 quickly and automatically leaves the first depressurizing port 160, and thus leading to form the second outgassing channel 144*c* between the top cover 16 and the flexible member 14 to communicate the first depressurizing port 160 to the second outgassing port 162, and causing the depressurizing device 6 having a faster depressurizing efficiency and not needing to set the solenoid valve. This also can prevent the depressurizing device 6 out of work from one of the outgassing channels is disable.

In some embodiments, the sum of a cross-sectional area of the first outgassing channel 144*a* and a cross-sectional area of the third outgassing channel 144*e* is in a range from $1\times10^{-3}$ mm$^2$ to 1 mm$^2$. In some embodiments, a depressurizing time for the depressurizing device 6 is within 2 seconds.

Figure 5A:
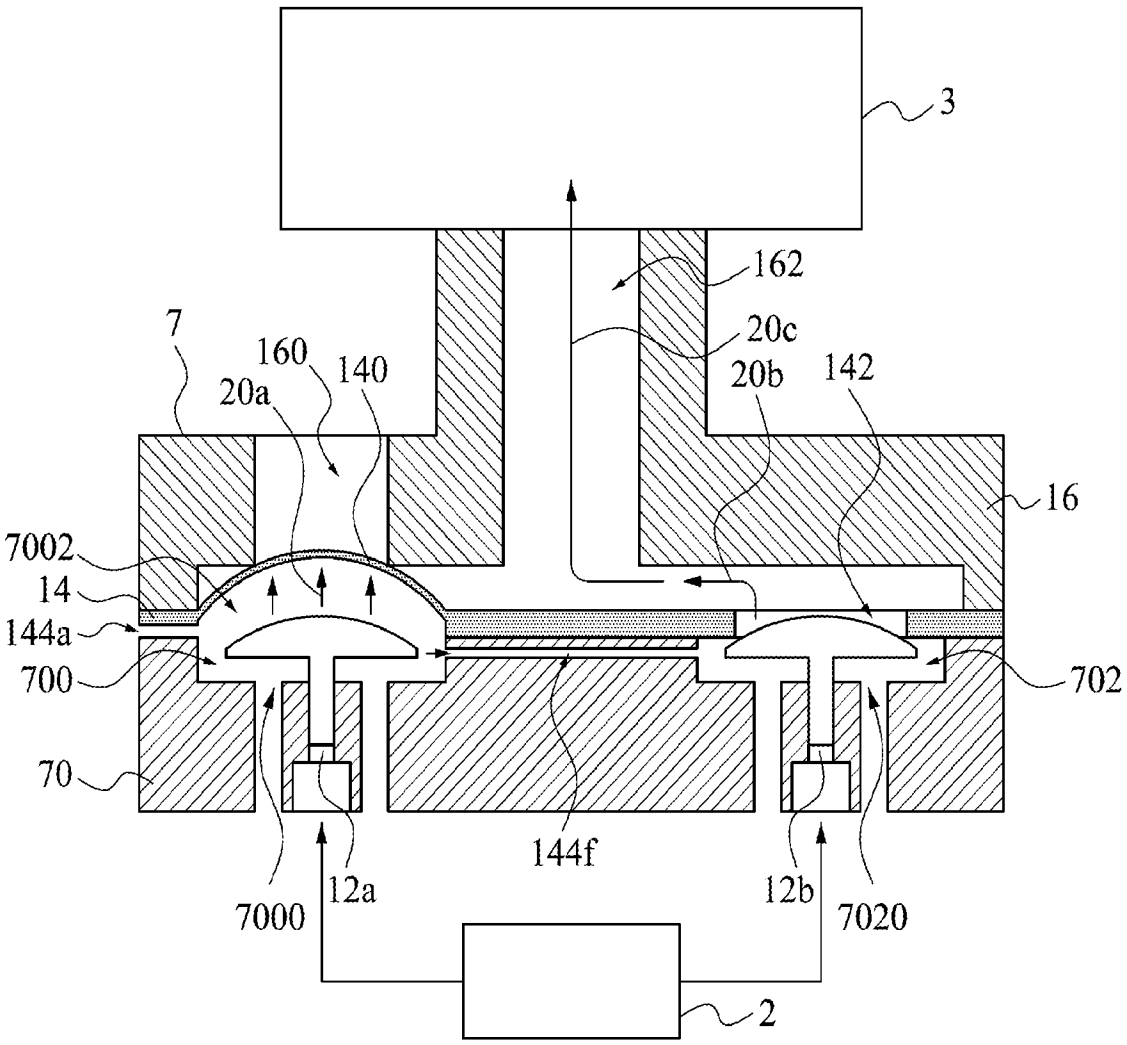
FIG. 5A is a schematic cross section view of a depressurizing device in an outgassing status in accordance with some embodiments of the present disclosure.
Figure 5B:
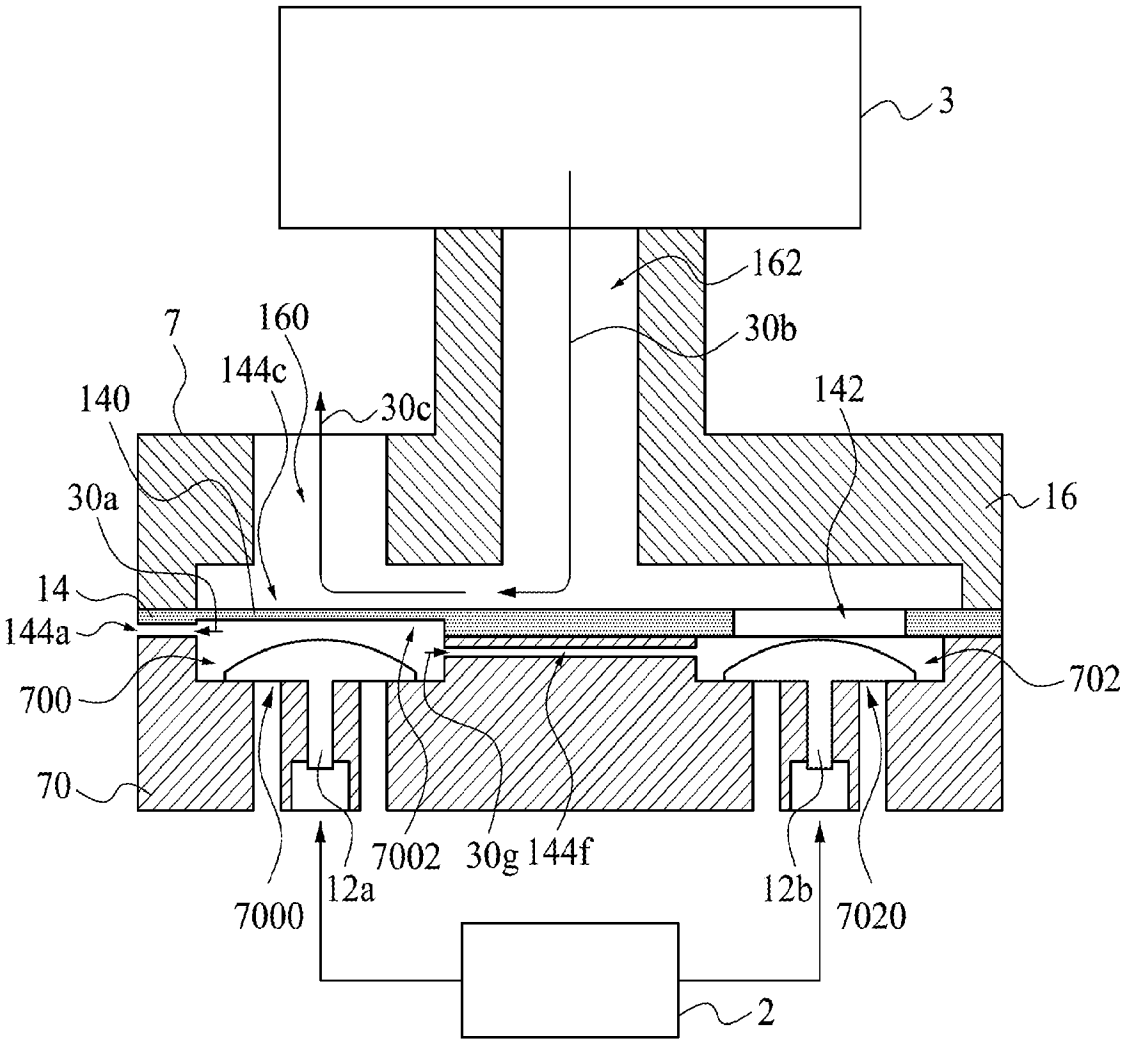
FIG. 5B is a schematic cross section view of the depressurizing device in a deflated status in an outgassing status in accordance with some embodiments of the present disclosure.

Reference is made to FIG. 5A and FIG. 5B. FIG. 5A is a schematic cross section view of a depressurizing device 7 in an outgassing status in accordance with some embodiments of the present disclosure. FIG. 5B is the schematic cross section view of the depressurizing device 7 in a deflated status in an outgassing status in accordance with some embodiments of the present disclosure. Firstly, as shown in the figures, in the present disclosure, the depressurizing device 7 also includes a valve base 70, a first valve 12*a*, a second valve 12*b*, a flexible member 14, and a top cover 16. The structure and function of the elements and the relationship therebetween are substantially the same as those of the embodiments in FIG. 1A and FIG. 1B, and the related detailed descriptions may refer to the foregoing paragraphs, and are not discussed again herein. The difference between the present embodiment and that in FIG. 1A and FIG. 1B are in that the valve base 70 in this embodiment has a third outgassing channel 144*f*. The third outgassing channel 144*f* communicates the pressure chamber 700 to the outgassing chamber 702. Therefore, the valve base 10 shown in the FIG. 1A and FIG. 1B is replaced with the valve base 70 in this embodiment.

Specifically speaking, as shown in FIG. 5A, when the user drives the depressurizing device 7 by a source generating unit 2, gas generated by the source generating unit 2 will enter the depressurizing device 7 through the first valve port 7000 and the second valve port 7020. The gas entering the depressurizing device 7 through the first valve port 7000 forms a pressure, and push the depressurizing valve 140 along a direction 20*a*, and thus the depressurizing valve 140 deforms to close the first depressurizing port 160, and thus leading to the first depressurizing port 160 disposed between the valve base 70 and the top cover 16 cannot communicate with the outgassing chamber 702 and the second outgassing port 162. Therefore, the gas entering the outgassing chamber 702 of the depressurizing device 7 through the second valve port 7020 can pass through the first outgassing port 142 of the flexible member 14 along a direction 20*b*, and enter the second outgassing port 162 along a direction 20*c* rather than enter the first depressurizing port 160. Whereby, the gas can enter an inflatable body 3 through the second outgassing port 162 to achieve an inflatable effect.

Then, as shown in FIG. 4B, when the user stops drive the depressurizing device 7 by a source generating unit 2, the first valve 12*a* and the second valve 12*b* will return to its original position and cover the first valve port 7000 and the second valve port 7020, and thus the gas will not flow back to the source generating unit 2. At the same time, the gas in the pressure chamber 700 respectively pass through a first outgassing channel 144*a* and the third outgassing channel 144*f* along direction 30*a* and direction 30*g* to leakage the gas. The pressure chamber 700 leakages gas, and thus the depressurizing valve 140 deforms to depression, and thus leading to the depressurizing valve 140 leaves and open the first depressurizing port 160, thereby forming a second outgassing channel 144*c* located between the top cover 16 and the flexible member 14. The second outgassing channel 144*c* communicates the first depressurizing port 160 and the second outgassing port 162. Therefore, the gas flowing back from the inflatable body 3 passes through the second outgassing port 162 along a direction 30*b* and enters the depressurizing device 7, and the gas passes through the second outgassing channel 144*c* and leakages from the first depressurizing port 160 along a direction 30*c*. In doing so, the first outgassing channel 144*a* and the third outgassing channel 144*f* can enable that the depressurizing valve 140 quickly and automatically leaves the first depressurizing port 160, and thus leading to form the second outgassing channel 144*c* between the top cover 16 and the flexible member 14 to communicate the first depressurizing port 160 to the second outgassing port 162, and causing the depressurizing device 7 having a faster depressurizing efficiency and not needing to set the solenoid valve. This also can prevent the depressurizing device 7 out of work from one of the outgassing channels is disable.

In some embodiments, the sum of a cross-sectional area of the first outgassing channel 144*a* and a cross-sectional area of the third outgassing channel 144*f* is in a range from $1\times10^{-3}$ mm$^2$ to 1 mm$^2$. In some embodiments, a depressurizing time for the depressurizing device 7 is within 2 seconds.

Figure 6A:
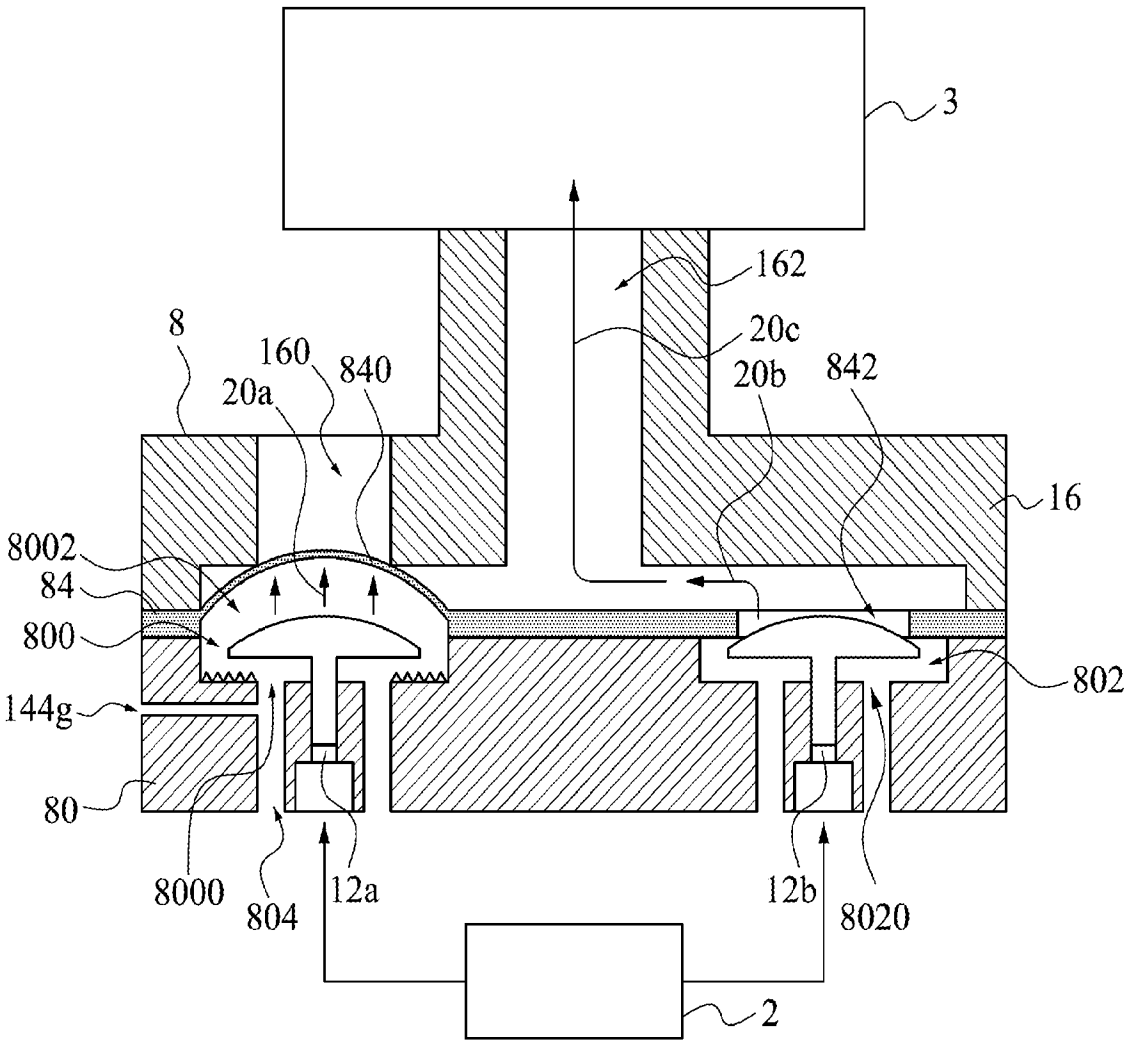
FIG. 6A is a schematic cross section view of a depressurizing device in an outgassing status in accordance with some embodiments of the present disclosure.
Figure 6B:
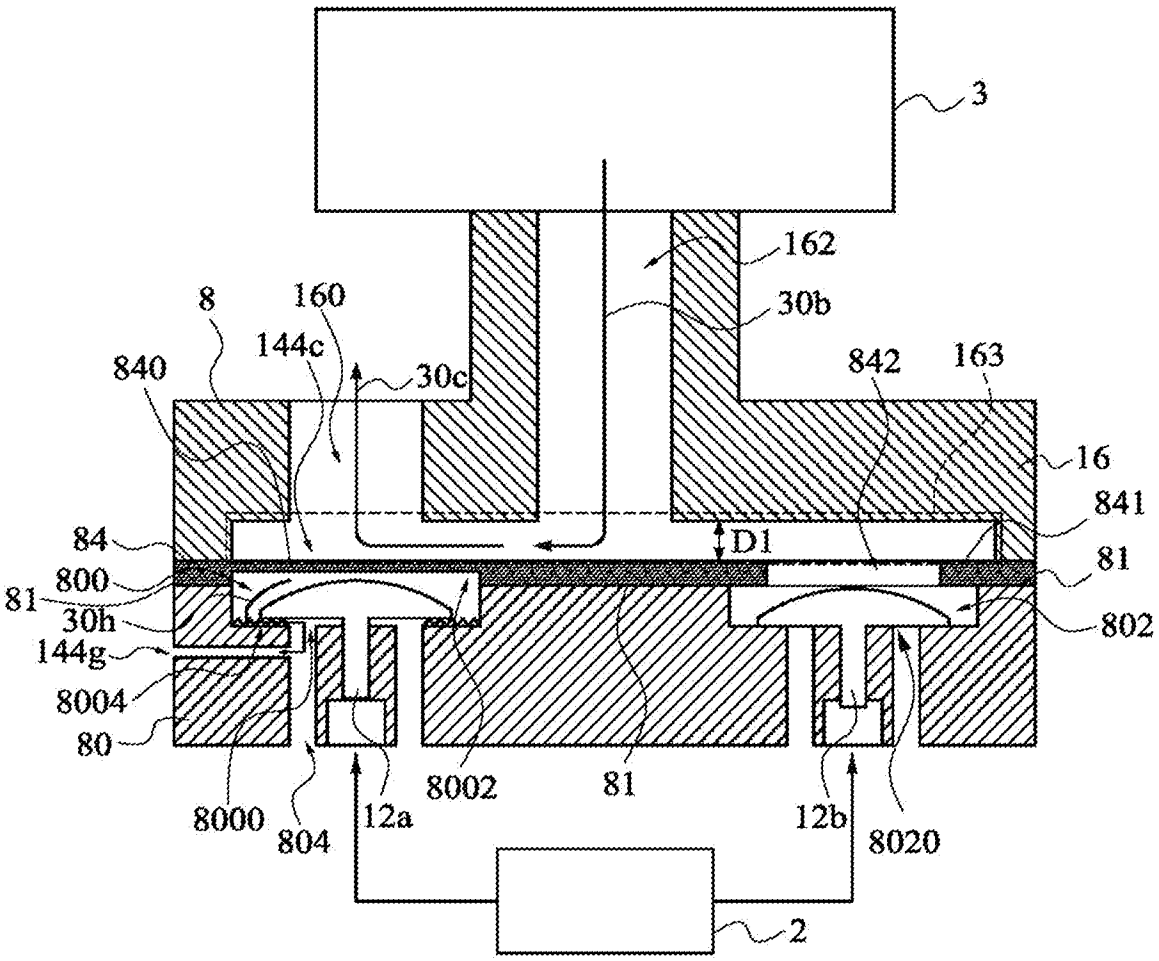
FIG. 6B is a schematic cross section view of the depressurizing device in a deflated status in an outgassing status in accordance with some embodiments of the present disclosure.

Reference is made to FIG. 6A and FIG. 6B. FIG. 6A is a schematic cross section view of a depressurizing device 8 in an outgassing status in accordance with some embodiments of the present disclosure. FIG. 6B is the schematic cross section view of the depressurizing device 8 in a deflated status in an outgassing status in accordance with some embodiments of the present disclosure. Firstly, as shown in the figures, in the present disclosure, the depressurizing device 8 includes a valve base 80, a first valve 12*a*, a second valve 12*b*, a flexible member 84, and a top cover 16. The structure and function of the elements and the relationship therebetween are described in detail hereinafter.

The valve base 80 has a pressure chamber 800 and an outgassing chamber 802. Top and bottom surfaces of the pressure chamber 800 have an opening 8002 and a first valve port 8000 respectively. The valve base 80 further has a valve port channel 804 being communicated with the pressure chamber 800 through the first valve port 8000. A bottom surface of the outgassing chamber 802 has a second valve port 8020. A first outgassing channel 144*g* is at least formed on the valve base 80 and communicates the valve port channel 804 to the outside of the valve base 80. The first valve 12*a* is located in the pressure chamber 800 and at least partially covers the first valve port 8000 to form a depressurizing gap 8004. The second valve 12*b* is located in the outgassing chamber 802 and covers the second valve port 8020. The flexible member 84 is disposed on the valve base 80 and has a depressurizing valve 840 and a first outgassing port 842. The depressurizing valve 840 covers the opening 8002. The first outgassing port 842 is communicated with the outgassing chamber 802. The top cover 16 is disposed on the flexible member 84 and has a first depressurizing port 160 and a second outgassing port 162. The first depressurizing port 160 faces the depressurizing valve 840. The second outgassing port 162 is communicated with the first outgassing port 842.

Specifically speaking, as shown in FIG. 6A, when the user drives the depressurizing device 8 by a source generating unit 2, gas generated by the source generating unit 2 will enter the depressurizing device 8 through the first valve port 8000 and the second valve port 8020. The gas entering the depressurizing device 8 through the first valve port 8000 forms a pressure, and push the depressurizing valve 840 along a direction 20*a*, and thus the depressurizing valve 840 deforms to close the first depressurizing port 160, and thus leading to the first depressurizing port 160 disposed between the valve base 80 and the top cover 16 cannot communicate with the outgassing chamber 802 and the second outgassing port 162. Therefore, the gas entering the outgassing chamber 802 of the depressurizing device 8 through the second valve port 8020 can pass through the first outgassing port 842 of the flexible member 84 along a direction 20*b*, and enter the second outgassing port 162 along a direction 20*c* rather than enter the first depressurizing port 160. Whereby, the gas can enter an inflatable body 3 through the second outgassing port 162 to achieve an inflatable effect.

Then, as shown in FIG. 6B, when the user stops drive the depressurizing device 8 by a source generating unit 2, the first valve 12*a* will return to its original position and covers the valve port channel 804 to form the depressurizing gap 8004, such that the gas in the pressure chamber 800 passes through the depressurizing gap 8004 and a first outgassing channel 144*g* along a direction 30*h* to leakage to outside of the valve base 80. The pressure chamber 800 leakages gas, and thus the depressurizing valve 840 deforms to depression, and thus leading to the depressurizing valve 840 leaves and open the first depressurizing port 160, thereby forming a second outgassing channel 144*c* located between the top cover 16 and the flexible member 84. The second outgassing channel 144*c* communicates the first depressurizing port 160 and the second outgassing port 162. Therefore, the gas flowing back from the inflatable body 3 passes through the second outgassing port 162 along a direction 30*b* and enters the depressurizing device 8, and the gas passes through the second outgassing channel 144*c* and leakages from the first depressurizing port 160 along a direction 30*c*. In doing so, the first outgassing channel 144*g* can communicate the pressure chamber 800 to the outside of the valve base 80, thereby accelerating recess speed of the depressurizing valve 840 during the depressurizing period, and thus the depressurizing valve 840 quickly and automatically leaves the first depressurizing port 160, and thus leading to form the second outgassing channel 144*c* between the top cover 16 and the flexible member 84 to communicate the first depressurizing port 160 to the second outgassing port 162, and causing the depressurizing device 8 having a faster depressurizing efficiency and not needing to set the solenoid valve.

In some embodiments, the top cover 16 is a non-elastic body. In some embodiments, the first valve 12*a*, the second valve 12*b*, and the flexible member 84 are made of rubber material. In some embodiments, the first valve 12*a* and the second valve 12*b* are umbrella valve, but the present disclosure is not limited thereto. In some embodiments, the depressurizing gap 8004 is formed by the valve port channel 804 is incompletely covered by the first valve 12*a*. For example, the depressurizing gap 8004 is formed by the method, such as a surface adjacent to the depressurizing gap 8004 and contacted the first valve 12*a* is a rough surface, a height of the first valve 12*a* is incomplete coverage to the valve port channel 804 during a depressurizing process, the first valve 12*a* has at least one channel to communicate the pressure chamber 800 to the valve port channel 804, the coverage area of the first valve 12*a* is smaller than the cross section of the valve port channel 804, or the combinations thereof. In some embodiments, value of increasing pressure of the depressurizing device 8 is in a range from 100 mmHg to 400 mmHg. In some embodiments, a cross-sectional area of the first outgassing channel 144*g* is in a range from $1\times10^{-3}$ mm$^2$ to 1 mm$^2$. In some embodiments, a depressurizing time for the depressurizing device 8 is within 2 seconds.

In some embodiments, the valve base 80 further includes a third outgassing channel 144*e* shown in FIG. 4A and FIG. 4B. The third outgassing channel 144*e* communicates the pressure chamber 800 to outside of the valve base 80. Its mechanism may refer to the preceding paragraphs shown on FIG. 4A and FIG. 4B and can cause the depressurizing device 8 having a faster depressurizing efficiency and not needing to set the solenoid valve. This also can prevent the depressurizing device 8 out of work from one of the outgassing channels is disable.

In some embodiments, the valve base 80 further includes a third outgassing channel 144*f* shown in FIG. 5A and FIG. 5B. The third outgassing channel 144*f* communicates the pressure chamber 800 to the outgassing chamber 802. Its mechanism may refer to the preceding paragraphs shown on FIG. 5A and FIG. 5B and can cause the depressurizing device 8 having a faster depressurizing efficiency and not needing to set the solenoid valve. This also can prevent the depressurizing device 8 out of work from one of the outgassing channels is disable.

Figure 7B:
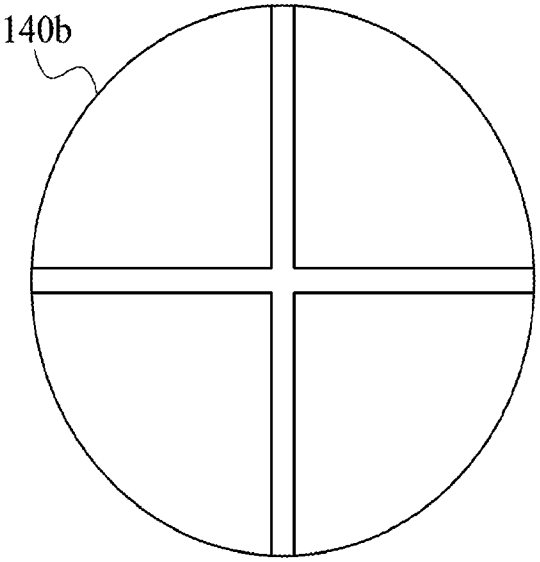
FIG. 7B is a schematic bottom view of another flexible member in accordance with some embodiments of the present disclosure.
Figure 7A:
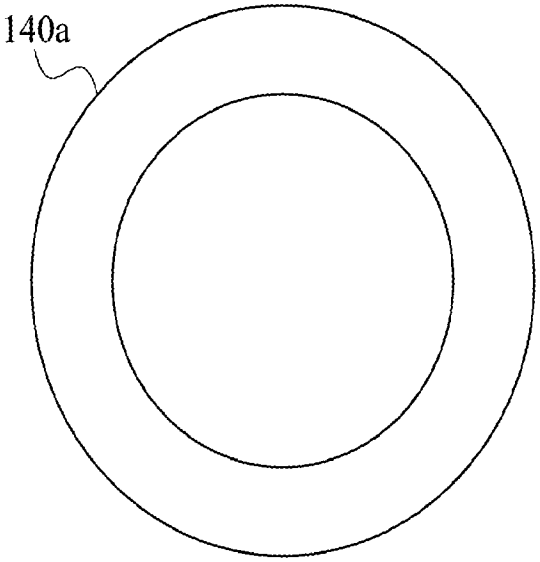
FIG. 7A is a schematic bottom view of a flexible member in accordance with some embodiments of the present disclosure.

Reference is made to FIG. 7A and FIG. 7B. FIG. 7A is a schematic bottom view of a flexible member in accordance with some embodiments of the present disclosure. FIG. 7B is a schematic bottom view of another flexible member in accordance with some embodiments of the present disclosure. As shown in FIG. 7A, in some embodiments, the depressurizing valve 140*a* has a concentric circles recess. As shown in the FIG. 7B, in the other embodiments, the depressurizing valve 140*a* has a cross shape recess but the present disclosure is not limited thereto. Whereby in depressurizing process, locally thinner of the depressurizing valve led the depressurizing valve is easily deformed, thereby accelerating recess speed of the depressurizing valve 140 during the depressurizing period, so that the depressurizing device may have a faster depressurizing efficiency.

According to the foregoing recitations of the embodiments of the disclosure, it can be seen that the depressurizing device includes the depressurizing valve. The first outgassing channel is at least formed on the depressurizing valve. Furthermore, the first outgassing channel may be also at least formed on the valve base to communicate the valve port channel to outside of the valve base. In doing so, the first outgassing channel can communicate the pressure chamber to the outside of the valve base, thereby accelerating recess speed of the depressurizing valve during the depressurizing period, and thus the depressurizing valve quickly and automatically leaves the first depressurizing port, and thus leading to form the second outgassing channel between the top cover and the flexible member to communicate the first depressurizing port to the second outgassing port, and causing the depressurizing device having a faster depressurizing efficiency. Furthermore, the outgassing channel is formed on the flexible member, thereby enabling the outgassing channel can be formed by the method, such as, an injection molding or a thermoforming technology, and thus may reducing the production costs. In addition, because the flexible member is easier configured to be molded, users can manufacture a variety type of the outgassing channels or the recesses. Moreover, users can replace the corresponding type of the flexible member having the outgassing channels or the recesses thereon according to their requirements, and can replace the flexible member in quickly and low-cost.

Reference is made to FIG. 6B. A first top surface 81 of the valve base 80 is a flat surface. A second top surface 841 of the flexible member 84 is a flat surface. An internal channel 163 of the top cove 16 is adjacent and parallel to the second top surface 841, and the internal channel 163 has the same height D1.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The invention claimed is:

1. A depressurizing device comprising:

a valve base having a pressure chamber and an outgassing chamber, top and bottom surfaces of the pressure chamber having an opening and a first valve port respectively, the valve base further having a valve port channel communicated with the pressure chamber through the first valve port, and a bottom surface of the outgassing chamber having a second valve port, wherein the valve base has a first outgassing channel which communicates the valve port channel to an outside of the valve base;

a first valve located in the pressure chamber and at least partially covering the first valve port to form a depressurizing gap;

a flexible member disposed on the valve base and having a depressurizing valve and a first outgassing port, the depressurizing valve covering the opening, the first outgassing port being communicated with the outgassing chamber; and a top cover disposed on the flexible member and having a first depressurizing port and a second outgassing port, the first depressurizing port facing the depressurizing valve, the second outgassing port being communicated with the first outgassing port, wherein the depressurizing valve is configured to deform caused by an effect of atmosphere in the pressure chamber, so as to selectively close the first depressurizing port or leave the first depressurizing port to form a second outgassing channel between the top cover and the flexible member, and the second outgassing channel is communicated with the first depressurizing port and the second outgassing port;

wherein the flexible member has a flat top surface;

wherein an internal channel is located on the flat top surface of the flexible member; wherein the internal channel communicates with the first depressurizing port, the second outgassing port, and the first outgassing port; and when the depressurizing valve deforms to an undeformed position, a height of the internal channel is the same height along an entire length of the internal channel, wherein the internal channel is over the depressurizing valve and the first outgassing port.

2. The depressurizing device of claim 1, further comprising:

a second valve located in the outgassing chamber and covering the second valve port.

3. The depressurizing device of claim 1, wherein a cross-sectional area of the first outgassing channel is in a range from $1\times10^{-3}$ $mm^2$ to 1 $mm^2$.

4. The depressurizing device of claim 1, wherein the valve base has a third outgassing channel communicating the pressure chamber to the outside of the valve base.

5. The depressurizing device of claim 1, wherein the valve base has a third outgassing channel communicating the pressure chamber to the outgassing chamber.

6. The depressurizing device of claim 4, wherein a sum of a cross-sectional area of the first outgassing channel and a cross-sectional area of the third outgassing channel is in a range from $1\times10^{-3}$ $mm^2$ to 1 $mm^2$.

* * * * *